US011013943B2

(12) United States Patent
Capsius

(10) Patent No.: US 11,013,943 B2
(45) Date of Patent: May 25, 2021

(54) WATER SPRAY VALVE SET FOR A FIRE EXTINGUISHING SYSTEM, AND FIRE EXTINGUISHING SYSTEM

(71) Applicant: MINIMAX GMBH & CO. KG, Bad Oldesloe (DE)

(72) Inventor: Christian Capsius, Rethwisch (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 104 days.

(21) Appl. No.: 16/310,990

(22) PCT Filed: May 30, 2017

(86) PCT No.: PCT/EP2017/063068
§ 371 (c)(1),
(2) Date: Dec. 18, 2018

(87) PCT Pub. No.: WO2017/220295
PCT Pub. Date: Dec. 28, 2017

(65) Prior Publication Data

US 2020/0139177 A1 May 7, 2020

(30) Foreign Application Priority Data

Jun. 23, 2016 (DE) ..... 10 2016 211 240.6

(51) Int. Cl.
*A62C 35/00* (2006.01)
*A62C 35/68* (2006.01)

(52) U.S. Cl.
CPC ..... *A62C 35/68* (2013.01)

(58) Field of Classification Search
CPC ..... A62C 35/68; A62C 35/62; A62C 35/64; A62C 35/645; A62C 37/44
(Continued)

(56) References Cited

U.S. PATENT DOCUMENTS 6,076,545 A * 6/2000 Cooper ..... A62C 35/68 137/360
2005/0087233 A1* 4/2005 Reilly ..... F16K 15/044 137/549
2008/0128144 A1* 6/2008 Blease ..... F16K 17/386 169/46

FOREIGN PATENT DOCUMENTS

DE 26 08 293 A1 9/1977
DE 298 17 872 U1 2/2000
(Continued)

OTHER PUBLICATIONS

International Search Report and Written Opinion (with English translation), International Application No. PCT/EP2017/063068 (published under WO 2017/220295), 18 pages (dated Aug. 10, 2017).

*Primary Examiner* — Qingzhang Zhou
(74) *Attorney, Agent, or Firm* — Perkins Coie LLP

(57) ABSTRACT

The present invention relates to a water spray valve set for a nozzle pipe system of a fire-extinguishing installation, having a water spray valve which has a fluid inlet for connection to a water supply, a fluid outlet for connection to the nozzle pipe system, and a closing body arranged between fluid inlet and fluid outlet, wherein the closing body is movable back and forth between a shut-off position and an opened-up position, wherein, in the shut-off position, the fluid inlet and fluid outlet are separated from one another and, in an opened-up position, said fluid inlet and fluid outlet are fluidically connected to one another, having a control line which is connected to a control pressure supply, and having at least one first control valve for controlling the control pressure in the control line, wherein the control line is operatively connected to the closing body such that the closing body is held in the shut-off position, or is in an opened-up position, in a manner dependent on an actuation
(Continued)

of the control valve. According to the invention, a relief line is provided which is connected to the control valve, wherein the control valve is designed to, when activated, relieve the control line of pressure via the relief line, such that the closing body is moved into the opened-up position, and to shut off the fluid connection between the control pressure supply and the closing body.

18 Claims, 2 Drawing Sheets

(58) Field of Classification Search
USPC .... 169/17, 19–22; 137/467, 527, 527.8, 551
See application file for complete search history.

(56) References Cited

FOREIGN PATENT DOCUMENTS

| | | | |
|---|---|---|---|
| DE | 10 2010 033 178 | B3 | 1/2012 |
| JP | Hei 11-164903 | A | 6/1999 |
| JP | 2004-243105 | A | 9/2004 |
| JP | 2006-055212 | A | 3/2006 |
| WO | WO 2006/082634 | A1 | 8/2006 |

* cited by examiner

WATER SPRAY VALVE SET FOR A FIRE EXTINGUISHING SYSTEM, AND FIRE EXTINGUISHING SYSTEM

PRIORITY CLAIM AND INCORPORATION BY REFERENCE

This application is a 35 U.S.C. § 371 application of International Application No. PCT/EP2017/063068, filed May 30, 2017, which claims the benefit of German Application No. 10 2016 211 240.6 filed Jun. 23, 2016, each of which is incorporated by reference in its entirety.

TECHNICAL FIELD

The invention relates to a water spray valve set for a nozzle pipe system of a fire-extinguishing installation, having a water spray valve which has a fluid inlet for connection to a water supply, a fluid outlet for connection to the nozzle pipe system, and a closing body arranged between fluid inlet and fluid outlet, wherein the closing body is movable back and forth between a shut-off position and an opened-up position, wherein, in the shut-off position, the fluid inlet and fluid outlet are separated from one another and, in an opened-up position, said fluid inlet and fluid outlet are fluidically connected to one another, having a control line which is connected to a control pressure supply, and having at least one first control valve for controlling the control pressure in the control line, wherein the control line is operatively connected to the closing body such that the closing body is held in the shut-off position, or is in an opened-up position, in a manner dependent on an actuation of the control valve. The invention also relates to a fire-extinguishing installation, in particular sprinkler or water spray extinguishing installation, having a nozzle pipe system and having a water spray valve set which is connected via one or more fluid lines to the nozzle pipe system.

BACKGROUND AND SUMMARY OF THE INVENTION

Water spray valve sets are known in the prior art which are provided for use in fire-extinguishing installations. If an alarm is output for example by a fire detector and/or extinguishing control station, the flow of an extinguishing agent from a water supply to the nozzle pipe system, to which a supply is to be provided via the water spray valve set, is ensured by means of a multiplicity of sprinkler nozzles.

The known water spray valve sets for nozzle pipe systems of a fire-extinguishing installation have at least one water spray valve which has a fluid inlet by means of which the water spray valve is connected to a water supply, such as for example the public water distribution system. The water spray valve furthermore has a fluid outlet for connection to the nozzle pipe system connected to the water spray valve set. The nozzle pipe system may have a single pipeline with multiple sprinkler nozzles and a pipeline network with a multiplicity of pipelines and sprinkler nozzles arranged thereon. Between the fluid inlet and the fluid outlet of the water spray valve, there is arranged a closing body which is movable back and forth between a shut-off position and an opened-up position. In the shut-off position, the fluid inlet and fluid outlet are fluidically separated from one another, such that no fluid flow of the extinguishing agent from the fluid inlet in the direction of the fluid outlet is possible. In the opened-up position of the closing body, it is then possible for the extinguishing agent, such as for example water, to flow from the fluid inlet in the direction of the fluid outlet.

The known water spray valve sets furthermore have a control line which is connected to a control pressure supply, and at least one first control valve for controlling the control pressure in the control line. Here, the control line is operatively connected to the closing body of the water spray valve such that the closing body is held in its shut-off position, or is in an opened-up position, in a manner dependent on an actuation of the control valve. Furthermore, a relief line is provided on the water spray valve. The relief line is in particular connected to a diaphragm chamber of the water spray valve, wherein the diaphragm in the diaphragm chamber may be the movable closing body itself or may be an actuating element or actuator mechanically coupled to the movable closing body.

If the control valve is activated in the event of a fire, whereby said control valve opens and furthermore the closing body moves from its shut-off position into an opened-up position, the fluid flow of the extinguishing agent from the fluid inlet in the direction of the fluid outlet of the water spray valve is permanently opened up in this way.

A disadvantage that arises in the case of the activation of a water spray valve set in the prior art can be seen in the architecture of the control valve. In order that the water spray valve remains in the opened-up position, it is necessary in the prior art to ensure that the fluid flow of the control medium flowing in through the control line is smaller than the fluid flow of the control medium exiting through the relief line. In this way, the action of force on the closing body is kept so low that said closing body is not moved into its shut-off position again. Furthermore, by means of the permanently flowing control medium, wherein water from the water supply is commonly used, instances of contamination can possibly be introduced into the water spray valve and the control valve by suspended substances contained in the control medium. In some cases, these instances of contamination may possibly lead to malfunctions in the controlled opening or closing of the water spray valve.

The invention was therefore based on the object of providing a water spray valve set which at least partially overcomes the disadvantages present in the prior art. In particular, the invention was based on the object of providing a water spray valve set which offers increased functional reliability.

The invention achieves the object on which it is based, in the case of a water spray valve set for a nozzle pipe system of a fire-extinguishing installation of the type mentioned in the introduction, by means of a relief line which is connected to the control valve, wherein the control valve is designed to, when activated, relieve the control line of pressure via the relief line, such that the closing body is moved into the opened-up position, and to shut off the fluid connection between the control pressure supply and the closing body.

The invention is based on the realization that, by means of a relief line connected to the control valve, to at least briefly relieve the control line of pressure such that the closing body is moved from its shut-off position into an opened-up position such that, in the water spray valve, the fluidic connection between the fluid inlet and the fluid outlet of the water spray valve is opened up, and thus a fluid flow of the extinguishing agent from the water supply in the direction of the nozzle pipe system, connected to the water spray valve set, of the fire-extinguishing installation is made possible. It is preferable for the control valve to be arranged within a portion of the control line and to have a further port for the relief line to be connected thereto. By means of the control valve, a switchover of the fluidic connection within the valve is preferably performed, such that a continuous flow of the control medium into the control line is prevented. In a preferred embodiment of the invention, the control valve is activated such that, after the control line has been relieved of pressure, the closing body in the water spray valve is moved from its shut-off position into an arbitrary opened-up position, such that the water spray valve is partially or fully opened. The closing body is preferably actuated by means of an actuating element coupled to the closing body, such that the degree of opening of the water spray valve is adjustable in continuously variable fashion. In this way, it is furthermore possible for the through flow rate of the extinguishing agent through the water spray valve to be controlled.

A preferred refinement of the invention provides for the control line to be connected via a control supply line to the fluid inlet of the water spray valve or of the water supply. The activation of the closing body is thus performed preferably by means of the extinguishing agent that is used, for example water. Furthermore, a short fluidic connection, which is easy to produce, for generating a control pressure in the control line is made possible.

In an alternative embodiment of the invention, the control line is connected at the inlet side via a control supply line to a separate control pressure source. In this way, activation of the closing body within the water spray valve can be performed independently of the extinguishing agent supply, whereby the autonomous operation of the water spray valve set is improved. As a control pressure source, use may preferably be made of a pressure vessel, a gas line or a compressor connected to the control line. The control medium used for the activation of the closing body may be a liquid, such as for example water or oil, or a gas, such as for example air.

It is preferable for a check valve to be arranged in the control supply line in order, in the event of pressure fluctuations or in the event of a pressure drop in the water supply or in a separate control pressure source, to prevent a pressure drop in the control line and thus inadvertent actuation of the water spray valve. The check valve is preferably designed to close in the event of a drop in the control pressure in the control line to below a predetermined minimum control pressure, which lies above the required control pressure, such that the closing body is held in the shut-off position in the water spray valve.

Within the control supply line, there is furthermore preferably arranged a filter device which ensures that suspended substances within the control medium are retained in the filter device. In this way, it is for example possible for instances of contamination, for example in a diaphragm chamber which accommodates the actuating element for the closing body, to be avoided. In this way, the functional reliability of the water spray valve set according to the invention is further increased.

Preferably, in one refinement of the invention, provision is made whereby, in the control supply line, there is arranged a restrictor which influences the flow speed of the fluid within the control line. With the use of a restrictor within the control supply line, it is possible for the flow speed at which the control medium flows through the control line to be influenced in targeted fashion. Furthermore, the closing speed of the water spray valve can be influenced in targeted fashion.

In a further embodiment of the invention, provision is made for the first control valve to be an electrically activatable control valve which is preferably connectable in signal-transmitting fashion to a fire detector and/or extinguishing control station. In the event of a fire, by means of the electrical activation, a simple and reliable actuation of the control valve is ensured in order to realize the necessary relief of pressure within the control line, which leads to the opening of the water spray valve. By means of the electrically activatable control valve, wherein the activation is performed by means of the fire detector and/or extinguishing control station, the water spray valve of the water spray valve set according to the invention can also be closed again, and the fire-extinguishing installation thus returned to an operationally ready state.

The electrically activatable first control valve is preferably a solenoid valve, preferably a 3/2-way solenoid valve, more preferably a bistable solenoid valve. The preferably bistable solenoid valve ensures that, once it has been activated, the control valve, even in the event of a malfunction or in the event of a failure of the activation signal, remains in the previously activated position. In the event of a fire, it is thus ensured that an actuated water spray valve remains permanently in an opened-up position and thus the fluid flow of the extinguishing agent between fluid inlet and fluid outlet of the water spray valve remains ensured.

Furthermore, the use of an electrically activatable control valve has the advantage that the control valve can be switched very accurately, whereby preferred opening states can be realized at the water spray valve. It is preferably possible for the control valve to be switched such that, after a first switching process, the control line is relieved of pressure, wherein, furthermore, the fluidic connection between the control pressure supply and the closing body is interrupted, and the closing body moves from its shut-off position into the opened-up position. By means of another or further activation of the control valve, the latter can be further actuated such that the fluidic connection between the control pressure supply and the closing body remains shut off, but a further relief of pressure in the control line is likewise prevented by virtue of the connection between the control line and the relief line being shut off. In this way, a residual fluid quantity of the control medium can be held for example within a diaphragm chamber with a diaphragm as actuating element. In this way, the closing body can be moved into an arbitrary opened-up position within the water spray valve.

In the case of a 3/2-way solenoid valve being used as electrically activatable control valve, portions or line sections of the control line are connected to two of the three fluid ports or outlets of the first control valve, or an end of the control line is connected to one outlet and an end of the control supply line is connected to the second outlet. The relief line is connected to the third port or outlet of the electrically activatable first control valve.

In a preferred refinement of the water spray valve set according to the invention, in the control line, there is additionally arranged a manually actuatable second control valve, to which a further relief line is connected. By means of the manually actuatable control valve, the fluidic connection between the control pressure supply and the closing body and thus the fluid flow of the control medium in the control line is likewise shut off. Furthermore, a fluidic connection between a portion of the control line and an additional relief line is produced, resulting in the relief of pressure in the control line being effected and a movement of the closing body from the shut-off position into an opened-up position. By means of the manually actuatable control valve, a manual functional check of the water spray valve set according to the invention is ensured.

The manually actuatable second control valve is preferably arranged in the control line downstream of the electrically activatable first control valve. In this way, a manual functional check of the water spray valve set is possible irrespective of an actuation of the first control valve. The term "downstream" relates to a flow direction of the control medium flows or would flow from the control pressure supply in the direction of the closing body, and the water spray valve is closed. In particular in the event of a fire, and in the case of an electrically activatable first control valve thus being actuated, the first control valve shuts off the connection between the control pressure supply and the closing body, and the control medium situated in the control line flows, oppositely to its otherwise normal flow direction, along at least one portion of the control line and of the connected relief line.

The manually actuatable second control valve is preferably a ball valve, preferably a 3/2-way ball valve. By means of a ball valve which is known in principle, a simple and reliable manual actuation of the water spray valve for a functional check of the water spray valve set according to the invention is ensured. Portions or line sections of the control line are connected to two of the three ports or outlets of the manually actuatable second control valve. An end of the further or additional relief line is connected to a third outlet of the second control valve.

In one refinement of the water spray valve set according to the invention, in each relief line, there is arranged at least one restrictor which influences the flow speed of the fluid in the relief line. By means of the restrictor in the one or more relief lines, the movement of the actuating element or actuator, and thus the opening speed of the closing body in the water spray valve of the water spray valve set, is influenced in targeted fashion.

In one refinement of the invention, provision is preferably made for the relief lines to be merged to form a common relief manifold line with exactly one restrictor. It is preferable for the free ends of the relief lines, which are connected to the electrically activatable first control valve and to the manually actuatable second control valve, to be merged. In this way, only a single outlet via which the control medium can flow out of the common relief manifold line is provided, irrespective of which of the control valves is actuated. Furthermore, it is preferable for the flow speed of the control medium in the two relief lines to be controlled by means of only one single restrictor. The structural design of the valve set is thus simplified.

The restrictors in the control supply line and in the relief lines or in the relief manifold line are preferably variably adjustable. With the variable adjustability at the restrictors, a variation of the restrictor cross section is made possible, whereby the flow cross section in the control supply line, in the relief lines or in the relief manifold line is influenced. The restrictor cross section at the restrictors is preferably adjustable in continuously variable fashion.

The closing body of the water spray valve preferably has a restoring element which is coupled to the closing body and which is designed to force the closing body in the direction of the shut-off position. With the provision of a restoring element, which is preferably in the form of a spring element, it is preferably realized that a minimum pressure is required to move the closing body, such as for example a valve disk, from its closed position into an opened-up position. Furthermore, by means of the restoring element, it is ensured that the extinguishing agent itself can be used as control medium for the activation of the actuating element which actuates the closing body. The extinguishing agent has a predetermined fluid pressure. It thus suffices for the control medium to be charged with a control pressure which is equal to the fluid pressure of the extinguishing agent in order to ensure the actuation of the closing body.

The closing body preferably has a spring-loaded valve disk or a valve diaphragm, with the aid of which simple and simultaneously reliable actuation of the water spray valve is possible. In a manner dependent on the forces acting on the valve disk or on the valve diaphragm, these are held either in the shut-off position or in any desired opened-up position (partial or complete opening). In a manner dependent on the opened-up position that is set, the water spray valve has a corresponding degree of opening.

A preferred embodiment of the water spray valve set according to the invention is distinguished by a discharge line with a discharge valve for the evacuation of the nozzle pipe system, wherein the discharge line is connected at the inlet side to the fluid outlet of the water spray valve or to the nozzle pipe system. By means of the discharge line, the evacuation of the nozzle pipe system connected to the water spray valve set is performed, in particular after an activation of the water spray valve, for example after a fire or after a functional check. With the evacuation of the nozzle pipe system, the fire-extinguishing installation is returned to an operationally ready state.

The discharge valve is preferably manually actuatable or connectable in signal-transmitting fashion to a fire detector and/or extinguishing control station. The establishment of the operationally ready state of the fire-extinguishing installation can thus be performed on-site and by remote control. The discharge valve preferably has an actuating lever or a hand wheel for manual actuation purposes. In a preferred refinement of the invention, the discharge valve alternatively or additionally has a remote-controllable actuating element which is mechanically coupled to the discharge valve. The actuating element, for example a solenoid valve, is couplable in signal-transmitting fashion, preferably via a signal line, to the fire detector and/or extinguishing control station.

A further aspect of the invention relates to a fire-extinguishing installation, in particular a sprinkler or water spray extinguishing installation, having a nozzle pipe system and a water spray valve set which is connected via one or more fluid lines to the nozzle pipe, wherein the water spray valve set is designed in accordance with one of the preferred embodiments described above. The invention is based on the realization that, by means of a control valve which is arranged preferably within a portion of a control line and which serves for controlling the control pressure in the control line and in a release line preferably connected to the control valve, the control valve can be activated such that at least the control line is relieved of pressure via the relief line. In this way, the closing body is moved from its shut-off position into an opened-up position, and furthermore, the fluidic connection between the control pressure supply and the closing body is shut off. In this way, an undesired continuous inflow of the control medium via the relief line into a collecting vessel, for example, is prevented. With regard to the advantages that result from this, reference is made to the above statements relating to the water spray valve set according to the invention.

The preferred embodiments or refinements that are furthermore described with regard to the water spray valve set are at the same time also preferred embodiments of the fire-extinguishing installation according to the invention. Preferred embodiments or refinements of the fire-extinguishing installation described herein which relate to the water spray valve set are at the same time preferred embodiments of the water spray valve set.

BRIEF DESCRIPTION OF THE DRAWINGS

Below, the invention will be described in more detail on the basis of preferred exemplary embodiments and with reference to the appended figures, in which.

MODE(S) FOR CARRYING OUT THE INVENTION

Figure 1:
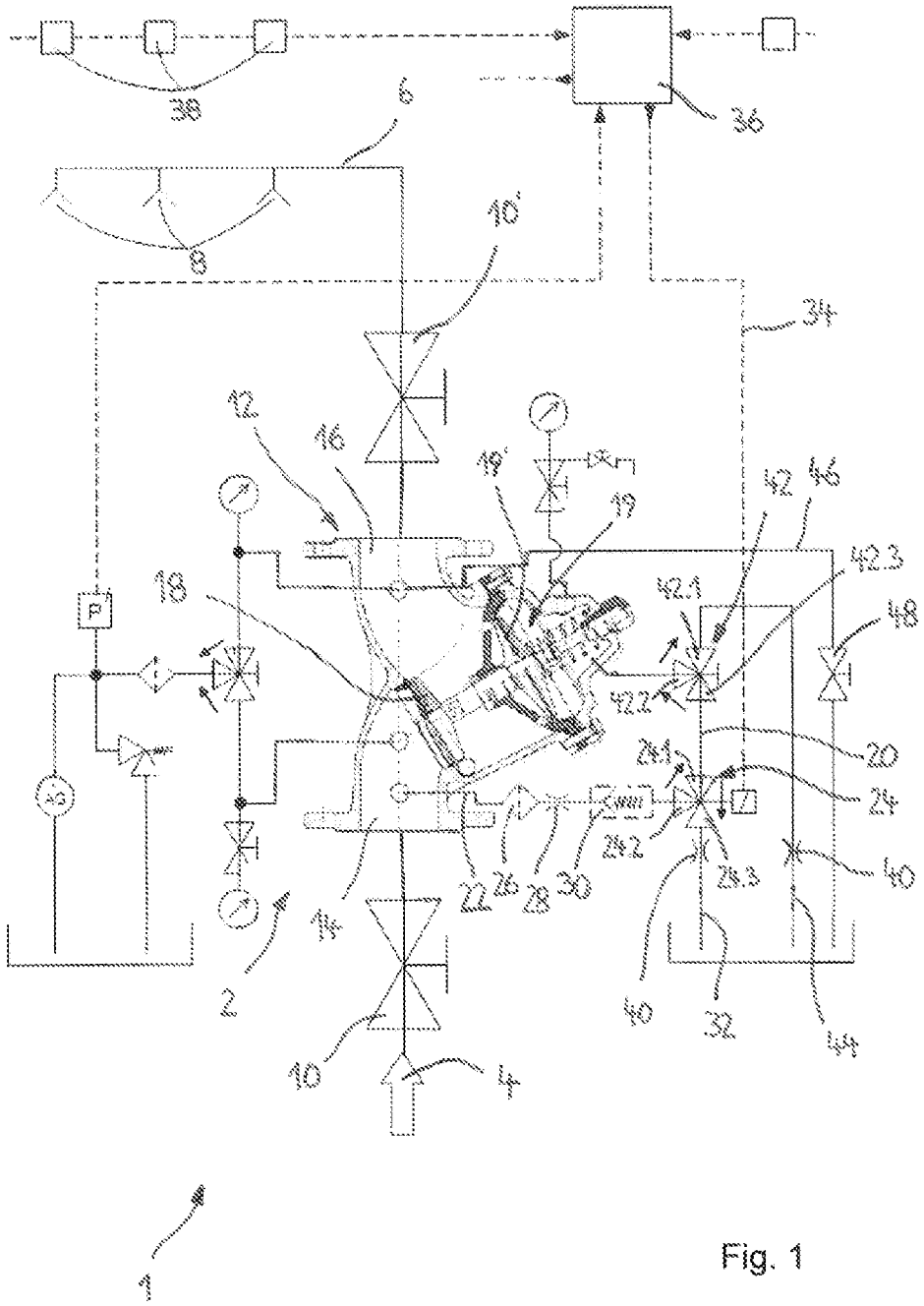
FIG. 1 is a schematic illustration of a fire-extinguishing installation according to the invention with a first exemplary embodiment of a water spray valve set.

FIG. 1 schematically shows a fire-extinguishing installation 1 having a water spray valve set 2 which is connected at an inlet side to a water supply 4. Furthermore, the water spray valve set 2 is connected at an outlet side to a nozzle pipe system 6. The nozzle pipe system 6 has a multiplicity of sprinkler nozzles 8. The inflow and outflow of water to and from the water spray valve set 2 is controlled by means of separate shut-off fittings 10, 10' arranged upstream and downstream of the water spray valve set 2.

The water spray valve set 2 comprises a water spray valve 12 with a fluid inlet 14 and a fluid outlet 16. The fluid inlet 14 is connected to the water supply 4, and the fluid outlet 16 is connected to the nozzle pipe system 6. Furthermore, the water spray valve 12 has a closing body 18 which is movable back and forth between a shut-off position (not illustrated in any more detail) and an opened-up position. The actuation of the closing body 18 is performed by means of an actuating element 19' arranged in a diaphragm chamber 19. Furthermore, the water spray valve 12 has a control line 20, wherein, in a manner dependent on the control of a control pressure in the control line 20, a force is exerted on the actuating element 19', whereby the closing body is either held in the shut-off position or is moved into the opened-up position. In the shut-off position of the closing body, the fluidic connection between the fluid inlet 14 and the fluid outlet 16 is interrupted. If the closing body 18 is situated in its opened-up position, the throughflow of the extinguishing agent from the fluid inlet to the fluid outlet of the water spray valve 2 is ensured.

In the embodiment shown in FIG. 1, the control line 20 is connected at the inlet side via a control supply line 22 to the fluid inlet 14 of the water spray valve 2. In an alternative embodiment which is not shown, the control supply line 22 is connected to the water supply 4 or to a separate control pressure source (not shown in any more detail). Furthermore, the water spray valve set 2 comprises a control valve 24, which connects the control supply line 22 and the control line 20 to one another. The control line 20 is connected to the port 24.1, and the control supply line 22 is connected to the port 24.2. During the normal operation of the fire-extinguishing installation 1, the control line 20 is fluidically connected via the control supply line 22 to the water supply 4, whereby a control pressure of predetermined intensity prevails in the diaphragm chamber 19, which control pressure acts on the actuating element 19' of the closing body 18 and holds the latter in its shut-off position. In the embodiment shown here, the actuating element 19' is additionally acted on by a restoring element 25 which forces the closing body 18 in the direction of the shut-off position and which is in the form of a pressure spring. In the control supply line 22, there are furthermore arranged a filter device 26, a restrictor 28 and a check valve 30.

Furthermore, a relief line 32 is connected to the port 24.3 of the control valve 24. In the embodiment shown, the control valve 24 is an electrically activatable control valve which is connectable in signal-transmitting fashion via a signal line 34 to a fire detector and/or extinguishing control station 36. If a fire situation is triggered by one or more fire detectors 38, then the control valve 24 is activated by means of the fire detector and/or extinguishing control station 36 such that the fluidic connection between the ports 24.1 and 24.2 is shut off and the connection between the ports 24.1 and 24.3 is opened. In this way, the control line 20 is relieved of pressure through the fluidic connection to the relief line 32, such that the control pressure in the diaphragm chamber 19 at least briefly falls. This has the result that the closing body 18 of the water spray valve 12 moves from its shut-off position into an opened-up position. Furthermore, the fluid flow from the fluid inlet 14 to the fluid outlet 16 of the water spray valve 12 and in the direction of the nozzle pipe network 6 is enabled. To control the relief of pressure in the control line in targeted fashion, a restrictor 40 is arranged in the relief line.

In addition to the control valve 24, a further control valve 42, which is in the form of a manually actuatable control valve, is arranged in the control line 20. The control line 20 is connected to the ports 42.2 and 42.3 of the control valve 42. A further relief line 44 is connected to the port 42.1 of the control valve 42. In the case of manual actuation of the control valve 42, the fluidic connection between the ports 42.2 and 42.3 of the control valve 42 is shut off, and the fluidic connection between the ports 42.1 and 42.2 of the control valve 42 is produced. In this way, the portion of the control line 20 between the control valve 42 and the closing body 18 is relieved of pressure via the relief line 44. The two control valves 24, 42 are designed to each relieve the control line 20, or a portion thereof, of pressure when the control valve 24 is electrically activated or the control valve 42 is manually actuated. Furthermore, a situation is prevented in which the control medium, in the example shown in FIG. 1 water from the water supply 4, flows into the control line 20 continuously. The additional relief line 44 is also equipped with a restrictor 40, whereby the relief of pressure in the control line 20 is adjustable in targeted fashion, and thus the opening speed of the water spray valve 12 can be influenced.

Furthermore, a discharge line 46 with a discharge valve 48 arranged in the discharge line is provided for the evacuation of the nozzle pipe system 6, wherein the discharge line 46 is, in the embodiment shown, connected to the fluid inlet 16 of the water spray valve 12.

Figure 2:
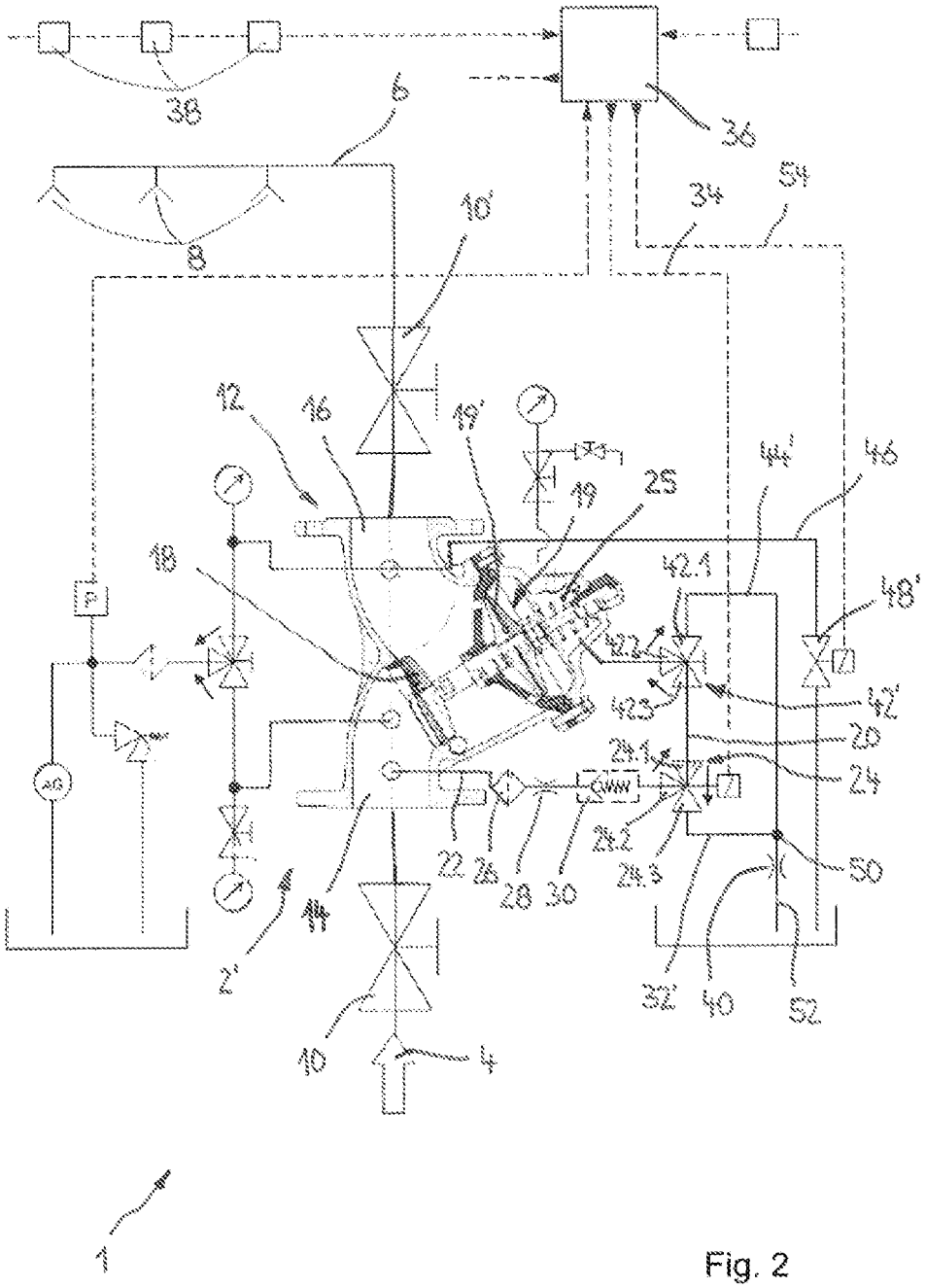
FIG. 2 is a schematic illustration of a fire-extinguishing installation according to the invention with a second exemplary embodiment of a water spray valve set.

FIG. 2 shows a further exemplary embodiment of a water spray valve set 2' according to the invention, which is of almost identical design to the embodiment of the water spray valve set 2 shown in FIG. 1. By contrast to the water spray valve set 2, the water spray valve set 2' has two relief lines 32', 44', which merge at a junction 50 to form a common relief manifold line 52.

Furthermore, in the second embodiment of the water spray valve set 2' according to the invention, only exactly one restrictor 40 is arranged in the relief manifold line 52. The relief of pressure in the control line 20 and in the water spray valve 12 connected thereto is then always controlled, irrespective of an activation of the control valve 24 or a manual actuation of the control valve 40, by means of the only one restrictor 40 in the relief manifold line 52. Also, in the embodiment of the water spray valve set 2' shown in FIG. 2, a discharge line 46 connected to the fluid outlet is connected to a discharge valve 48'. By contrast to the embodiment shown in FIG. 1, the discharge valve 48' is activated in signal-transmitting fashion by means of the fire detector and/or extinguishing control station 36 via a signal line 54. In an alternative embodiment, the discharge line 46 may be connected to a portion of the nozzle pipe system 6.

LIST OF UTILIZED REFERENCE NUMBERS

1 Fire-extinguishing installation
2, 2' Water spray valve set
4 Water supply
6 Nozzle pipe system
8 Sprinkler nozzles
10, 10' Shut-off fitting
12 Water spray valve
14 Fluid inlet
16 Fluid outlet
18 Closing body
19 Diaphragm chamber
19' Actuating element
20 Control line
22 Control supply line
24 Control valve
24.1, 24.2, 24.3 Port
25 Restoring element
26 Filter device
28 Restrictor
30 Check valve
32, 32' Relief line
34 Signal line
36 Fire detector and/or extinguishing control station
38 Fire detector
40 Restrictor
42 Control valve
42.1, 42.2, 42.3 Port
44, 44' Relief line
46 Discharge line
48,48' Discharge valve
50 Junction
52 Relief manifold line
54 Signal line

The invention claimed is:

1. A water spray valve set for a nozzle pipe system of a fire-extinguishing installation, comprising:

a water spray valve which has a fluid inlet for connection to a water supply, a fluid outlet for connection to the nozzle pipe system, and a closing body arranged between the fluid inlet and the fluid outlet, wherein the closing body is movable back and forth between a shut-off position and an opened-up position, wherein, in the shut-off position, the fluid inlet and fluid outlet are separated from one another and, in the opened-up position, said fluid inlet and fluid outlet are fluidically connected to one another, a control line which is connected to a control pressure supply, at least one control valve for controlling the control pressure in the control line, wherein the control line is operatively connected to the closing body such that the closing body is held in the shut-off position, or is in the opened-up position, in a manner dependent on an actuation of the at least one control valve, and a relief line connected to the at least one control valve, wherein the at least one control valve, when activated, relieves the control line of pressure via the relief line, such that the closing body is moved into the opened-up position, and shuts off fluid connection between the control pressure supply and the closing body, wherein the at least one control valve comprises a first control valve and a second control valve, and wherein the first control valve, the second control valve, and a chamber of the water spray valve are connected in series by the control line.

2. The water spray valve set as claimed in claim 1, wherein the control line is connected at an inlet side via a control supply line to the fluid inlet of the water spray valve or a water supply.

3. The water spray valve set as claimed in claim 2, wherein a check valve is arranged in the control supply line.

4. The water spray valve set as claimed in claim 3, wherein a filter device is arranged in the control supply line.

5. The water spray valve set as claimed in claim 2, wherein, in the control supply line, there is arranged a restrictor which influences a flow speed of fluid within the control line.

6. The water spray valve set as claimed in claim 1, wherein the first control valve is an electrically activatable control valve connected to the relief line and is connectable for signal transmission to a fire detector and/or extinguishing control station.

7. The water spray valve set as claimed in claim 6, wherein the electrically activatable first control valve is a solenoid valve, wherein the solenoid valve is one of a 3/2-way solenoid valve and a bistable solenoid valve.

8. The water spray valve set as claimed in claim 6, wherein the second control valve comprises a manually actuatable second control valve to which a further relief line (44, 44') is connected.

9. The water spray valve set as claimed in claim 8, wherein the manually actuatable second control valve is arranged in the control line downstream of the electrically activatable first control valve.

10. The water spray valve set as claimed in claim 8, wherein the manually actuatable second control valve is a ball valve.

11. The water spray valve set as claimed in claim 8, wherein each of the relief line and the further relief line comprises one or more restrictors which influence a flow speed of fluid in the relief line and the further relief line.

12. The water spray valve set as claimed in claim 8, wherein the relief line and the further relief line are merged to form a common relief manifold line with exactly one restrictor.

13. The water spray valve set as claimed in claim 5, wherein the restrictor is variably adjustable.

14. The water spray valve set as claimed in claim 1, wherein the closing body has a restoring element which is coupled to the closing body and which is designed to force the closing body in the direction of the shut-off position.

15. The water spray valve set as claimed in claim 1, wherein the closing body has a spring-loaded valve disk or a valve diaphragm.

16. The water spray valve set as claimed in claim 1, further comprising a discharge line with a discharge valve for the evacuation of the nozzle pipe system, wherein the discharge line is connected at an inlet side to the fluid outlet of the water spray valve or to the nozzle pipe system.

17. The water spray valve set as claimed in claim 16, wherein the discharge valve is manually actuatable or is connectable for signal transmission to a fire detector and/or extinguishing control station.

18. A fire-extinguishing installation comprising:

a nozzle pipe system, and a water spray valve set which is connected via one or more fluid lines to the nozzle pipe system, wherein the water spray valve set is designed as claimed in claim 1.

* * * * *